US006955272B2

(12) United States Patent
Collins

(10) Patent No.: US 6,955,272 B2
(45) Date of Patent: Oct. 18, 2005

(54) BABY BOTTLE BIB

(76) Inventor: Lisa B. Collins, 115 E. Fir St., Brea, CA (US) 92821

( * ) Notice: Subject to any disclaimer, the term of this patent is extended or adjusted under 35 U.S.C. 154(b) by 0 days.

(21) Appl. No.: 10/378,420

(22) Filed: Mar. 3, 2003

(65) Prior Publication Data

US 2004/0173557 A1 Sep. 9, 2004

(51) Int. Cl.[7] ..... A61J 9/08
(52) U.S. Cl. ..... 215/11.6; 215/392
(58) Field of Search ..... 215/11.6, 386, 215/392; 150/154, 901; 220/903; D9/444, 625; 248/346.1

(56) References Cited

U.S. PATENT DOCUMENTS

| | | | | | |
|---|---|---|---|---|---|
| 747,025 | A | * | 12/1903 | White | 215/12.1 |
| 2,154,772 | A | * | 4/1939 | Rathemacher | 215/12.1 |
| 2,409,820 | A | * | 10/1946 | Zimmern | 215/12.1 |
| D167,207 | S | * | 7/1952 | Haars | D7/624.3 |
| 3,085,612 | A | * | 4/1963 | Gobel | 215/11.6 |
| 4,282,279 | A | * | 8/1981 | Strickland | 224/414 |
| 4,401,245 | A | * | 8/1983 | Zills | 224/148.3 |
| 4,473,907 | A | * | 10/1984 | Maillard | 2/48 |
| 4,526,280 | A | * | 7/1985 | Taylor | 215/395 |
| 4,780,911 | A | * | 11/1988 | Mack | 2/49.1 |
| 5,188,877 | A | * | 2/1993 | Magaro | 428/80 |
| 5,490,289 | A | * | 2/1996 | Lehrer | 2/49.2 |
| D391,483 | S | * | 3/1998 | Freeman | D9/444 |
| D403,209 | S | * | 12/1998 | Zigterman | D7/624.2 |
| 5,858,014 | A | * | 1/1999 | Kepes et al. | 604/387 |
| 5,898,940 | A | * | 5/1999 | Cameron | 2/49.1 |
| 6,228,459 | B1 | * | 5/2001 | Bujalski | 428/80 |
| 6,363,530 | B1 | * | 4/2002 | Lampson et al. | 2/49.1 |
| 6,585,711 | B1 | * | 7/2003 | Lohrasbi | 604/385.07 |
| 6,612,452 | B2 | * | 9/2003 | Heilner | 215/392 |
| 6,659,545 | B1 | * | 12/2003 | McMillan | 297/153 |

FOREIGN PATENT DOCUMENTS

| | | | | |
|---|---|---|---|---|
| EP | 0417834 A1 | * | 3/1991 | |
| FR | 2669512 A1 | * | 5/1992 | A41B/13/10 |

* cited by examiner

*Primary Examiner*—Sue A. Weaver
(74) *Attorney, Agent, or Firm*—Michael A. Shippey; Law Offices of Karla Shippey

(57) ABSTRACT

This invention is a bib that slides onto a drinking bottle to form a protective barrier against spills or spit-up by the person drinking. The bib is made of lightweight, soft, and absorbent materials, which may be disposable or washable.

6 Claims, 5 Drawing Sheets

BABY BOTTLE BIB

BACKGROUND OF THE INVENTION

1. Field of the Invention

The present invention relates to a bib that is attached to a drinking bottle to form a protective barrier against spills or spit-up from a child drinking from the bottle. The bib is easily accessible for wiping and cleaning up dribbles and spills made while the child is drinking. It is made of absorbing material that can be disposable or washable and that is lightweight and soft. It is specially designed to minimize the risk of blocking the child's breathing or of interfering with inhalation. The invention keeps the person who is feeding the child from becoming covered with the spilled contents while allowing for continued feeding with minimal interruption.

2. Description of Related Art

No prior art was found that teaches the present invention.

Much of the prior art teaches bibs or devices attached to an infant or adult, rather than to the bottle. Most of these focus on devices that hold a bottle in a secure and rigid drinking position without the need for parent contact:—U.S. Pat. No. 6,000,664 teaches a bib that straps to the person feeding a baby with adjustable straps to hold the bottle facing downwards in a set position; U.S. Pat. No. 5,184,796 teaches an inflatable bottle holding device that is strapped around a seated child; U.S. Pat. No. 6,055,667 teaches a bib with a wedge and straps to hold a tipped bottle or cup in place on the chest of a child who is reclining or seated at various angles; U.S. Pat. No. 5,898,940 teaches a bib worn by the child with a loop for holding a bottle in a set position for feeding; U.S. Pat. No. 5,765,225 teaches a bib worn by the child with a harness or structure attached for holding the bottle.

U.S. Pat. No. 5,048,121 teaches an entire bottle-feeding system, complete with a rigid bottle holding device to be laid over the front of the baby and a bib that slides into slots on the device to hold it in position under the infant's chin.

Some prior art is related to devices that cover or slide over the bottle. U.S. Pat. No. 1,210,892 teaches a device that covers a bottle such that the bottle is completely concealed during feeding. U.S. Pat. Nos. 5,183,229 and 2,033,296 teach rigid devices that fit over a bottle to hold it in feeding position without another person's contact. U.S. Pat. No. 5,114,374 and Design U.S. Pat. No. 393,075 teach decorative collars that form or attach to the bottle cap.

A few prior art devices have added to the standard baby bib to improve its effectiveness These include U.S. Pat. No. 5,666,665 (bib with a detachable dribble roll to absorb small spills).

Another series of prior art is focused on the prevention of bottle spillage, contamination, or breakage. U.S. Pat. No. 4,050,600 teaches a device for preventing spillage from a bottle by means of a rigid ring device that attaches to the bottle cap. U.S. Pat. No. 1,683,205 teaches a device that attaches to the bottom of a cup or bottle to catch drips and spills. U.S. Pat. Nos. 2,706,571 and 3,405,829 relate to rigid devices that cover the bottle for purposes of preventing breakage of the bottle, and U.S. Pat. No. 4,934,542 teaches a device that attaches to the bottle cap and shields the nipple from contamination in case the bottle is dropped. U.S. Design Pat. No. 458,380 teaches a decorated protective collar that slides over the bottle cap.

SUMMARY OF THE INVENTION

The present invention comprises a lightweight, rounded bib that is slid over a child's bottle and that is made of absorbing material that may be disposable or washable. The bib protects the person feeding the child from spillage or spit-up as the child is drinking, and it can be swung around the bottle to catch and clean up dribbles or spillage on the child's face. Once soiled, a bottle bib can be easily slid off the bottle and a clean bottle bib can be slid onto the bottle, even while the child is still drinking.

The bib can be made out of any washable, soft, lightweight, liquid absorbing material, such as fabric commonly used to make towels or bathrobes. It can also be made out of disposable materials that have been specially made for liquid absorption, such as paper or cotton batting or quilting materials. In its preferred embodiment, the bib material consists of several layers. For example, in a preferable mode, the invention comprises a three layer material consisting of an outer layer of lightweight lining, an inner layer of a soft and absorbent cotton or synthetic batting or quilting, covered by a third layer of semi-permeable or directionally-permeable material that captures liquid, in such a way that it is absorbed into the inner absorbent layer. Therefore the surface of the material stays dry or nearly dry. The exact material and construction can vary, but it is essential that the material be absorbent and liquid-capturing.

The bib has a bottle-sized hole, with aperture approximately 1.5 to 2.5 inches in diameter, which is off-set toward one side and which has a special elastic or otherwise clinging collar to keep the bib from sliding down the bottle onto the face of the drinking child. This collar holds the bib to the bottle at any point along the bottle that is desired by the person feeding the child. It can be pushed up or down along the bottle length as needed. It is not attached to the bottle cap or top. In this way, the bib is kept from coming into contact with the drinking child's face and will not inhibit inhalation.

A further feature that may or may not be added to the bib is the imprinting of shapes and designs on the side of the bib that faces the drinking child. The intent of these shapes and designs is to provide interest for the child, a focus for the eyes, and stimulation for brain development.

The bib has been designed to be made of inexpensive and lightweight materials that can be easily packaged in large quantity, whether the bibs are made washable or disposable. Furthermore, the bib has been made of highly absorbent material, to efficiently capture all of the spilled liquid. This is useful in minimizing messiness, and also in other capacities.

BRIEF DESCRIPTION OF THE DRAWINGS

The invention will now be described, by way of example only, with references to the accompanying drawings, as follows.

DETAILED DESCRIPTION OF THE INVENTION

The present invention is an innovative bib device for the protection of infants and their surroundings from the effects of spilled milk or formula during the act of nursing from a bottle. The bib comprises a substantially circular or oval-shaped cloth, either natural cloth, as terry cloth, or synthetic cloth, such as the material used in disposable diapers. Hereafter it will be understood that the invention constructed with synthetic cloth is the preferred embodiment, in that it is disposable.

The disposable materials of the current invention have been specially made for liquid absorption, such as paper or cotton batting or quilting materials. In its preferred embodiment, the bib material consists of several layers. For example, in a preferable mode, the invention comprises a three layer material consisting of an bottom layer 7 of lightweight lining, an inner layer 6 of a soft and absorbent cotton or synthetic batting or quilting covered by a top layer 5 of semi-permeable or directionally-permeable material that captures liquid in such a way that it is absorbed into the inner absorbent layer the surface of the material stays dry or nearly dry. The exact material and construction can vary, but it is essential that the material be absorbent and liquid-capturing.

The bib further contains an opening (substantially oval or circular in the preferred embodiment), centered about half-way between the center of the bib and the top edge. (Of course, in the circular embodiment, all edges are equivalent.) The opening is surrounded by elastic material of sufficient strength to fit a full bottle of formula. The elastic is capable of fitting a bottle between 1½ and 2½ inches in diameter, the range of circular dimension of most infant bottles.

Figure 1:
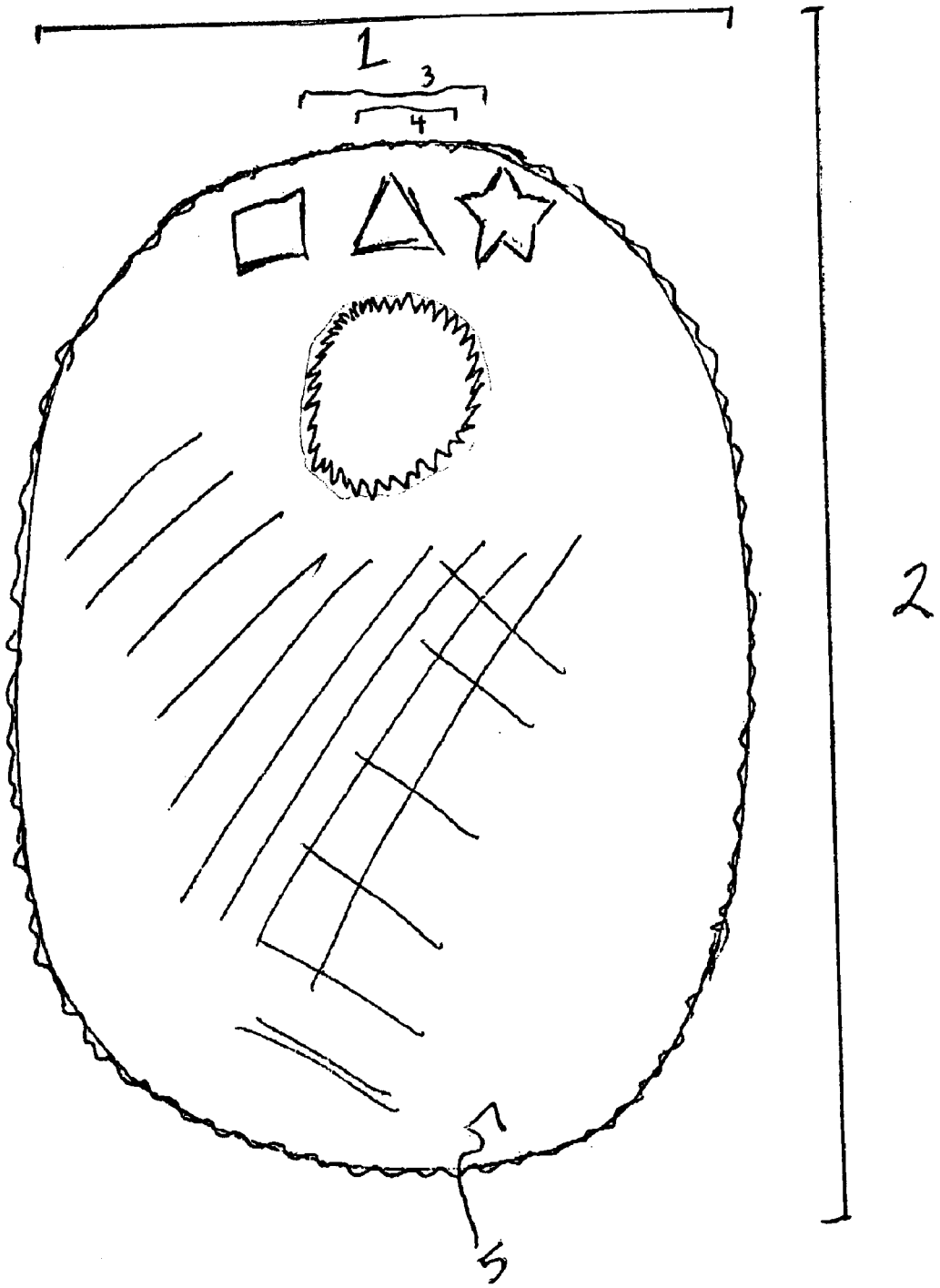
FIG. 1 depicts the invention from a front view, the side that would face the infant. This shows the preferred embodiment, comprising a disposable synthetic material.

The preferred embodiment is substantially flat, as portrayed in FIG. 1. It is designed to fit around the neck of an infant bottle inserted in the elastic-surrounded aperture of the bib. Either face of the bib can face the infant; preferably, the absorbent side 5 of the bib will face the infant. It is thus in position to catch and absorb any spilled or emitted liquid.

Dimensions 1 and 2 are not particularly critical, except that each must exceed dimension 3 by a substantial margin. In our best mode case, the bib is substantially oval or circular in shape, and dimensions A and B are approximately equal, and about 8–10 inches. Dimension 4, the maximum diameter of the aperture, is critical in that it must comfortably admit the bottom of an infant bottle, up to the neck, without being so large as not to secure it comfortably. Dimension 3 is simply the width of the aperture plus the additional width taken up by the elastic material. These dimensions can vary slightly according to the application. We have found that a value of dimension 3=2¾ inches and dimension 4=approximately 2½ inches is ideal for most applications. Note that because of the elastic surrounding the aperture, dimension 4 can shrink to about 1½ inches.

Figure 2:
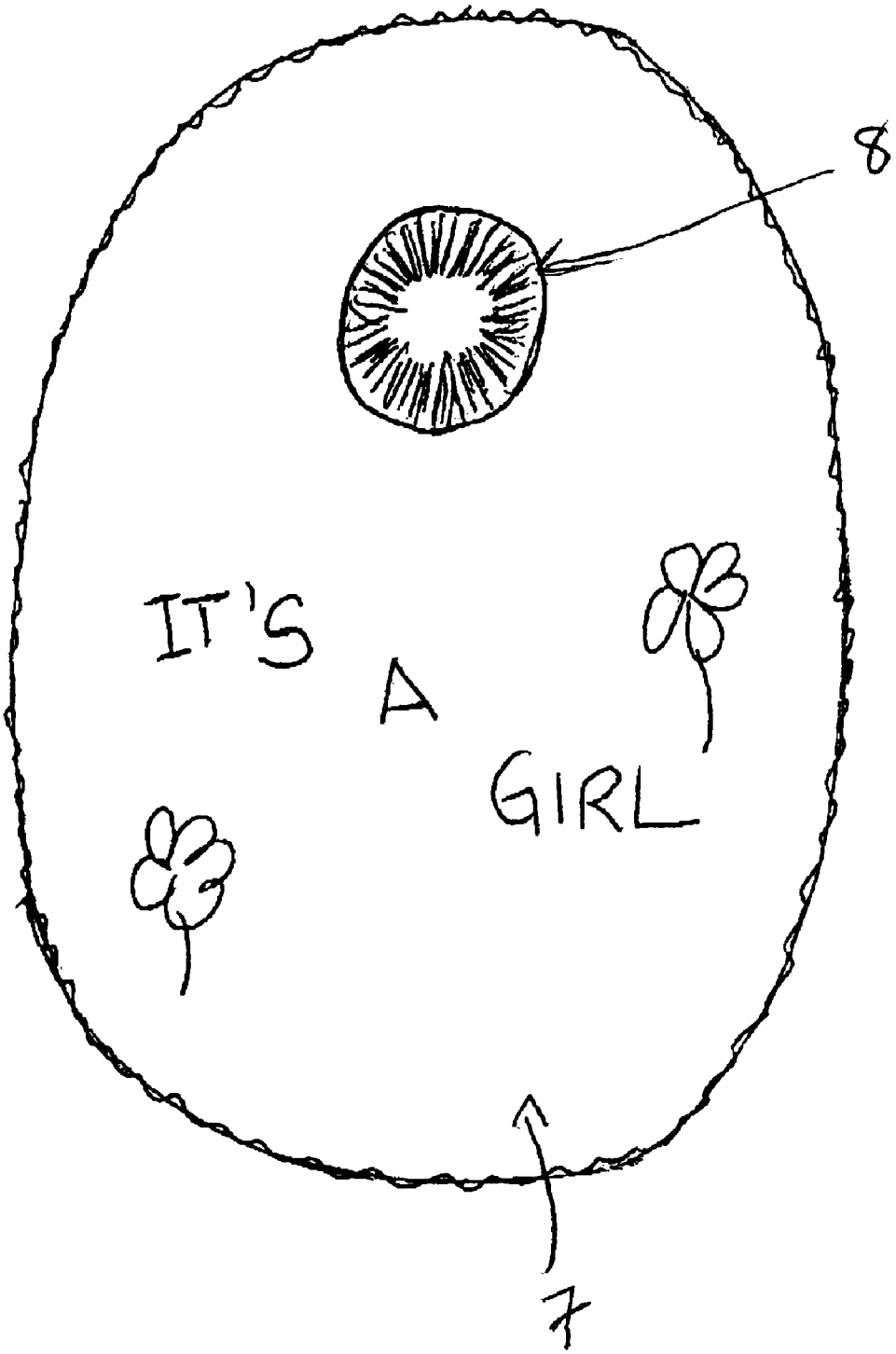
FIG. 2 depicts the invention from the opposite side, the side facing away from the infant. Essentially the only difference in form from the first side (presented in FIG. 1) is the presence of the elastic collar, which extends from this surface when in use. This collar is the preferred contact point for supporting the bottle. The feeder's hand is thus protected by the bib from spilled liquid.
Figure 3:
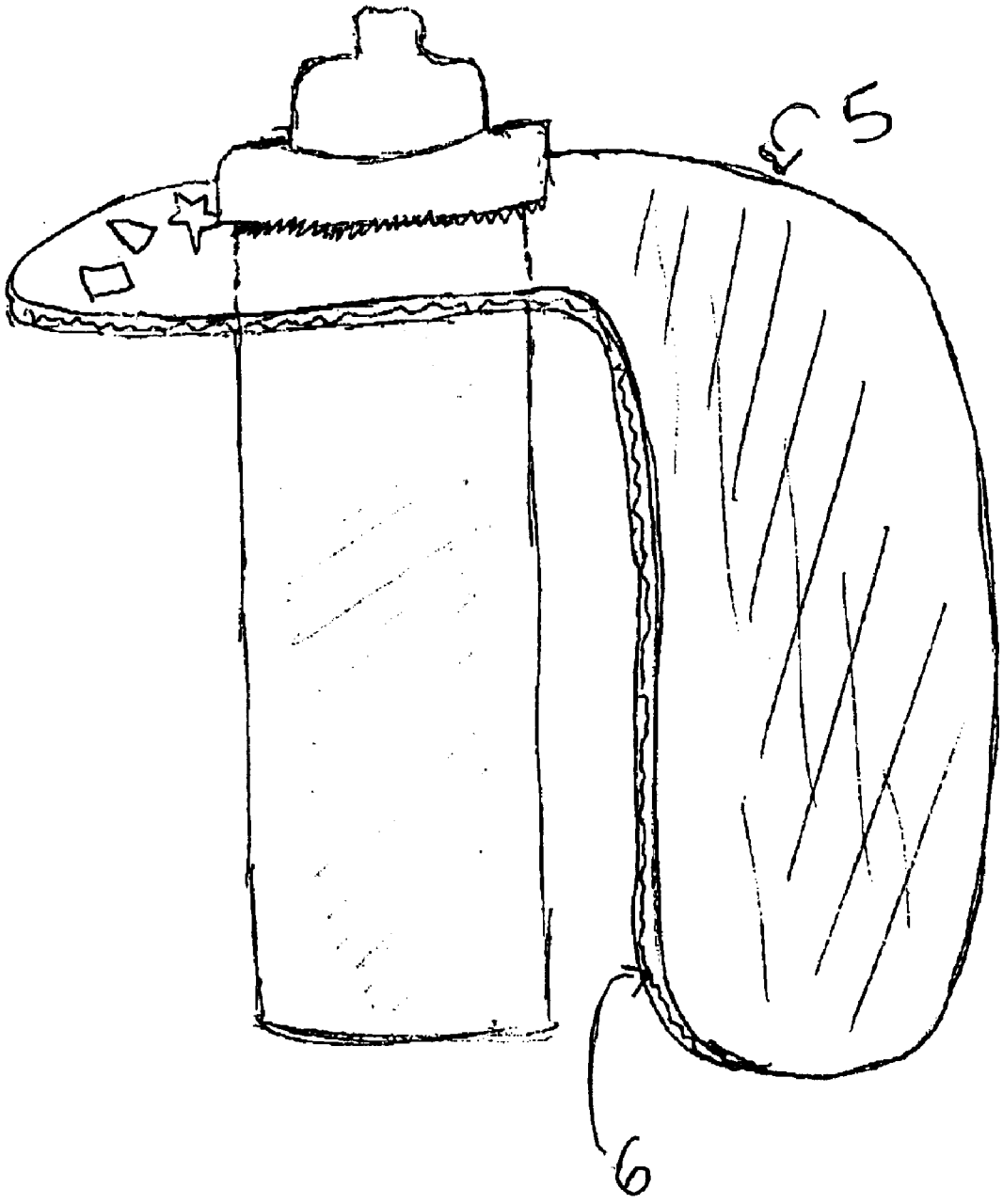
FIG. 3 depicts the invention from a side view, showing layers of materials in the preferred embodiment of the invention, and showing the elastic collar that surrounds the opening for a bottle in the preferred embodiment of the invention. A bottle, not part of the current invention, is shown to demonstrate the position and fit of the bib of the current invention.

FIG. 2 is the view of the surface of the bib 7 that faces away from the infant, showing the elastic collar. This collar is the preferred contact point for supporting the bottle. The bib from spilled liquid thus protects the feeder's hand, and is firmly supported thereby.

A convenient method of properly placing the bib onto the bottle is to place the bib on a flat surface, opposing side down. Then stand the bottle atop the bib, over the aperture, and slide the bib up until it surrounds the neck of the bottle. By this method, the bib is placed at the correct location, in the proper orientation, with the correct surface facing the infant, and the elastic collar 8 properly situated for fitting on the bottle.

While this device is primarily intended for use in the home, it can equally well be used in a hospital, nursery, or other institution of infant and childcare. In this service, the current invention can also serve to help monitor liquid uptake by the infant, a critical parameter often used by doctors and child care professionals. Thus, as the current invention is efficient in capturing spilled liquid, the practitioner can weigh the bib before and after feeding the infant, and calculate the amount of spilled formula or liquid by difference. This calculated amount is then subtracted from the measured amount of liquid dispensed from the bottle. The result of this calculation is the amount of liquid actually consumed by the infant, calculated to a much more precise degree than is achieved by current methods.

Figure 4:
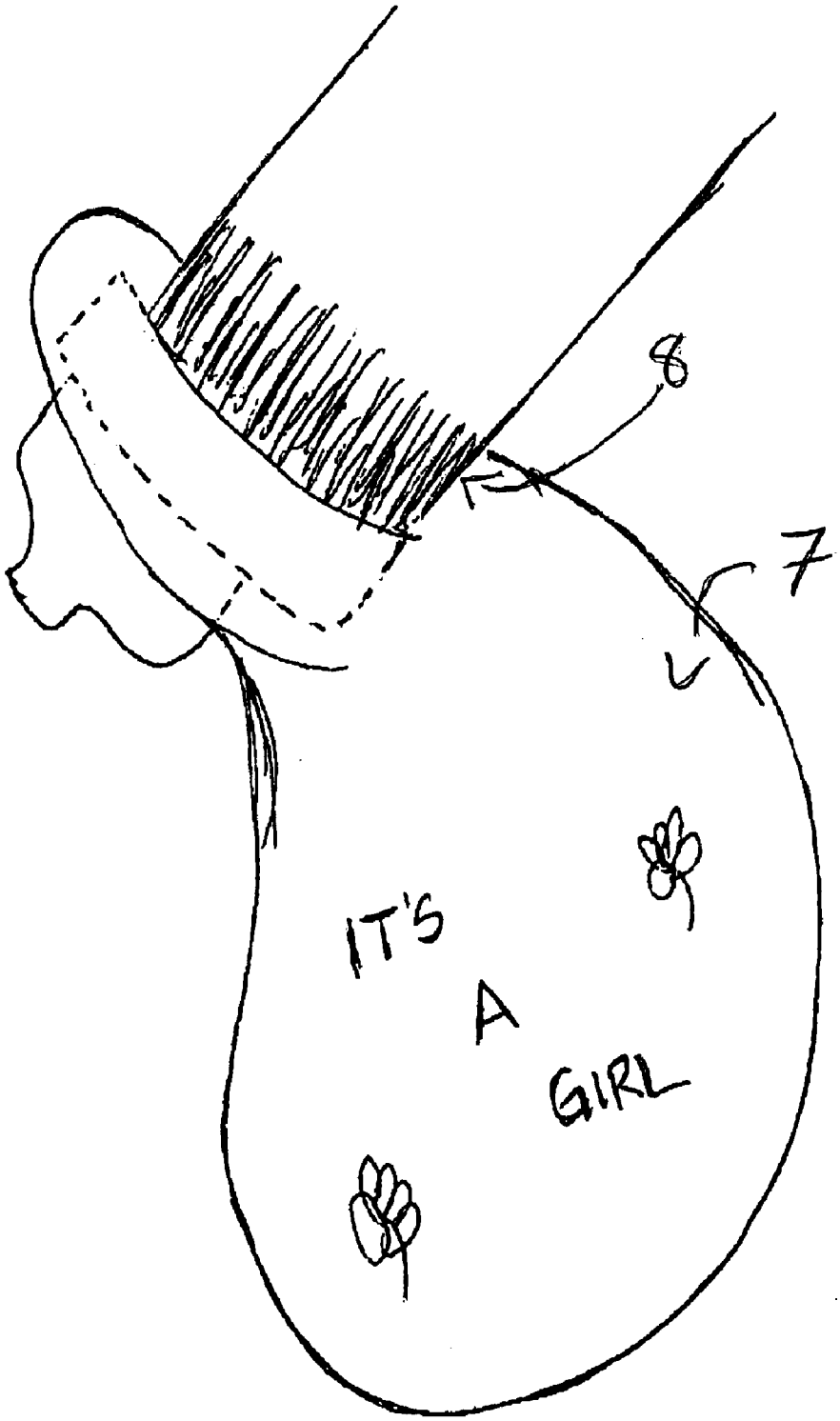
FIG. 4 depicts the invention from a side view, slightly to the underside. In this view can be seen the elastic material around the aperture in the bib. The elastic material binds the bottle to the bib, allows the holder of the bottle to hold both bottle and bid securely, and averts leakage of spilled liquid through the aperture.
Figure 5:
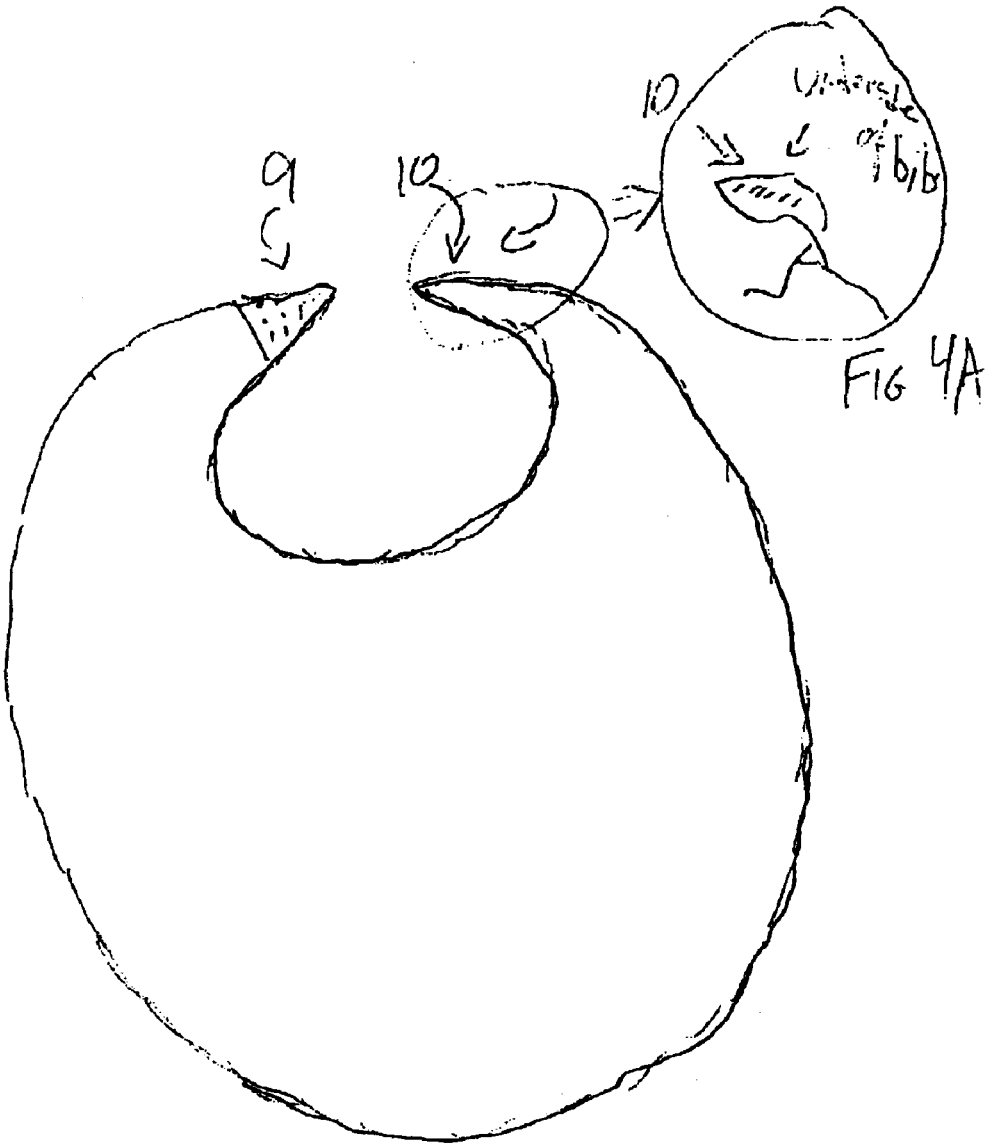
FIG. 5 depicts another embodiment of the invention from a front view. This is the reusable cloth embodiment of the invention. The back view is identical. Note the Velcro™ fastener facing at the right upper corner of this bib. A matching fastener on the underside of the upper left corner (as shown in the inset 4A) allows the bib to enclose around the bottle.

Yet another embodiment of the current invention is the open collar bib displayed in FIG. 4. This bib has Velcro™ or similar fasteners on the upper side of the tip of the left hand collar 9, and on the underside of the tip of the right hand collar 10. (Of course, the locations of the fasteners could be reversed, or otherwise slightly changed, without fundamentally affecting the invention.) When the two fasteners are contacted and fastened to each other, the bib can be snugly fitted around a bottle in the same fashion as the bib of the preferred embodiment. This embodiment has the advantage of being washable after use, and thus reusable. A larger version of this bib embodiment can be easily converted for use as an infant bib.

While the present invention has been described in terms of several preferred embodiments, it is not intended to limit the invention to the particular forms set forth. On the contrary, the present invention is intended to cover such alternatives, alterations, modifications, and equivalent structures and devices as may be included within the spirit and scope of the invention as defined within the appended claims.

What is claimed is:

1. In combination, a drinking vessel including a liquid retaining portion having a circumference and having a first end and a second end and comprising at least one wall, said drinking vessel having a nipple extending from said first end of said liquid retaining portion for extracting liquid therefrom; and an absorbent apparatus removably attached to said at least one wall, wherein the improvement comprises an absorbent apparatus comprising:

A lightweight bib or guard, comprising a substantially flat surface for shielding, for an infant formula or milk bottle said surface including an aperture suitable for the insertion and close fitting of said drinking vessel.

2. A device as described in claim 1 in which said bib is further comprised of a single integral piece of construction, without need for assembly or fastening by the user, other than insertion of said drinking vessel.

3. A device as described in claim 1 in which said bib is further comprised of cloth, preferably terrycloth.

4. A device as described in claim 1 in which said bib is further comprised of a disposable clothlike synthetic material, which is capable of absorbing liquid, and with one surface substantially waterproof.

5. A device as described in claim 1 wherein said aperture is expandable to a maximum of 1.5 to 2.5 inches in diameter.

6. A device as described in claim 1 wherein said aperture is surrounded by elastic material, to hold said bib in proper position on said drinking vessel.

* * * * *